US007666519B2

(12) United States Patent
Ozaki

(10) Patent No.: US 7,666,519 B2
(45) Date of Patent: Feb. 23, 2010

(54) HIGH TEMPERATURE SLIDING ALLOY

(75) Inventor: Kouki Ozaki, Inuyama (JP)

(73) Assignee: Daido Metal Company Ltd., Nagoya (JP)

( * ) Notice: Subject to any disclaimer, the term of this patent is extended or adjusted under 35 U.S.C. 154(b) by 395 days.

(21) Appl. No.: 11/410,006

(22) Filed: Apr. 25, 2006

(65) Prior Publication Data

US 2006/0237101 A1 Oct. 26, 2006

(30) Foreign Application Priority Data

Apr. 25, 2005 (JP) ..... 2005-126448

(51) Int. Cl.

| | |
|---|---|
| ***C22C 38/10*** | (2006.01) |
| ***C22C 19/05*** | (2006.01) |
| ***B22F 3/10*** | (2006.01) |
| ***B32B 5/30*** | (2006.01) |
| ***B32B 15/01*** | (2006.01) |
| ***B32B 15/18*** | (2006.01) |

(52) U.S. Cl. ..... 428/546; 428/680; 428/681; 428/615; 148/320; 148/427; 148/579; 148/675

(58) Field of Classification Search ..... None
See application file for complete search history.

(56) References Cited

U.S. PATENT DOCUMENTS 3,836,394 A * 9/1974 Kugler et al. ..... 427/456
4,474,861 A * 10/1984 Ecer ..... 428/614
4,961,781 A * 10/1990 Morishita et al. ..... 75/244
6,139,599 A * 10/2000 Takahashi et al. ..... 75/246
6,318,327 B1 * 11/2001 Takahashi et al. ..... 123/188.3
2005/0150759 A1 * 7/2005 Chang ..... 204/192.38
2005/0158571 A1 * 7/2005 Takayama et al. ..... 428/544

FOREIGN PATENT DOCUMENTS

| | | |
|---|---|---|
| JP | 52-097311 | 8/1977 |
| JP | 01-108349 A | 4/1989 |
| JP | 11 172363 | 6/1999 |

OTHER PUBLICATIONS

JP 11-172363 English Machine Translation, Ozaki et al., Jun. 1999.*

* cited by examiner

*Primary Examiner*—Jennifer McNeil
*Assistant Examiner*—Jason L Savage
(74) *Attorney, Agent, or Firm*—Browdy and Neimark PLLC

(57) ABSTRACT

A high temperature sliding alloy has a matrix 1 of a Ni-base alloy or a heat resistant Fe-base alloy, and contains, by mass, 1 to 35% hard particles consisting of a Co-base intermetallic compound dispersed therein, wherein 0.1 to 10% Ag is dispersed in the matrix. Ag is a soft metal, forms an ultrathin film on a sliding surface caused by sliding with a mating member, and presents a lubricating effect. When Ag forms the ultrafine film and spreads on the sliding surface, it works little as a frictional force against the mating member due to its low shear resistance, and accordingly can achieve a low coefficient of friction.

10 Claims, 4 Drawing Sheets

HIGH TEMPERATURE SLIDING ALLOY

TECHNICAL BACKGROUND OF THE INVENTION

The present invention relates to a high temperature sliding alloy containing hard particles consisting of a Co-base intermetallic compound being dispersed in a matrix of a Ni-base alloy or an Fe-base alloy; a method of producing the same; and a sliding system using the high temperature sliding alloy.

PRIOR ART

A bearing for wheels of a carriage or the like, which is used when charging or taking out an article to be heat-treated into or from a furnace for heat treatment, is required to have excellent characteristics such as a wear resistance property, not only under a high-temperature condition in the furnace but also under an ordinary-temperature condition.

A high temperature sliding alloy which satisfies such a requirement is disclosed in a patent document of JP-A-11-172363. The alloy consists of 2 to 8 mass % Cr, 2 to 10 mass % Fe, 0.1 to 1.5 mass % Si, 2 to 22 mass % Co, 1.4 to 11 mass % Mo and the balance of Ni, and contains 1 to 35 mass % of Co—Mo—Cr—Si-based hard particles dispersed in the matrix.

The high temperature sliding alloy shown in JP-A-11-172363 is produced by mixing a raw powder, compressing the mixed powder, sintering it in a reducing atmosphere at 1,150° C., and subsequently heating it in an oxidizing atmosphere at 600 to 900° C. Thereby, among hard particles 2 dispersed in the matrix 1 of the Ni-base alloy as shown in FIG. 3, portions of the hard particles exposed from the surface (sliding surface) of a matrix 1 are oxidized to form an oxide phase of Co—Mo—Cr—Si 2*a*. In addition, the oxide phase 2*a* is oxidized to be an oxide phase 2*b* of Co—Cr, and a molybdenum oxide phase 2*c* is formed on the oxide phase 2*b*.

When these oxide phases is brought into sliding-contact with a mating member, the molybdenum oxide phase 2*c* with lubricity is transferred to the mating member to bring out a lubricating effect. In addition, the hard and brittle oxide phase 2*b* of Co—Cr is finely broken into fine grains which roll between the sliding alloy and the mating member thereby presenting a certain rolling friction action. According to the above publication, such actions resolve the stick-slip phenomenon to realize a low coefficient of friction between the sliding alloy and the mating member.

However, the high temperature sliding alloy has had a problem that it cannot achieve a low coefficient of friction in a low temperature range of not higher than 400° C., in comparison with use in a high temperature range of higher than 400° C. It is believed that this is because a hard particle newly exposed at a sliding surface by wear is not easily oxidized in the low temperature range of not higher than 400° C., so that a composite oxide required for achieving the low coefficient of friction is hard to be formed on the surface of the hard particles.

The present invention has been proposed in view of the above technical background.

An object of the invention is to provide a high temperature sliding alloy capable of achieving a low coefficient of friction even in a low-temperature varying range, a method of producing the same, and a sliding system using the high temperature sliding alloy.

BRIEF SUMMARY OF THE INVENTION

JP-A-11-172363 is a patent application filed by the assignee of the present application. The present inventors conducted an earnest research on a high temperature sliding alloy shown in JP-A-11-172363 to achieve a low coefficient of friction in a low-temperature range of not higher than 400° C. Finally, the inventors found that a chemical composition of the present invention, especially additive Ag, is effective in achieving the low coefficient of friction, whereby resulting in the present invention.

According to a first aspect of the invention, there is provided a high temperature sliding alloy which is of a Ni-base alloy or an Fe-base alloy, and which contains, by mass percent, 1 to 35% of hard particles consisting of a Co-base intermetallic compound, and 0.1 to 10% Ag, the each content of the hard particles and Ag being a proportion to the whole sliding alloy, wherein the hard particles and Ag are dispersed in the matrix of the Ni-base alloy or the Fe-base alloy.

A soft metal of Ag forms an extremely thin film on a sliding surface under a sliding-contact relationship with a mating member to present a lubrication effect. Because of low shear resistance of Ag, when Ag forms the extremely thin film and extends on the sliding surface, it has a little influence on the mating member as a frictional force, and accordingly can achieve a low coefficient of friction.

In addition, Ag has high oxidation resistance, hardly forms an oxide even at a considerably high temperature, and keeps its soft state. Besides, Ag has an extremely low degree of solubility (compatibility) in a metal (such as Ni, Fe and Cr) composing a matrix, and accordingly can exist in the matrix while keeping the state of the single phase of Ag without forming a solid solution. Thus, Ag exists in the state of the single phase of Ag up to a considerably high temperature of around 800° C., and achieves a low coefficient of friction.

When the content of Ag is less than 0.1 mass %, the effect is not obtained. On the other hand, even if the Ag content exceeds 10 mass %, the effect of lowering the coefficient of friction does not increase any more, and further the addition of more than 10 mass % Ag increases the material cost too much, because Ag is one of noble metals. Accordingly, the Ag content should be 0.1 to 10 mass %.

More preferably the Ag content is 1 to 7 mass %, desirably 2 to 4 mass %.

When the content of hard particles consisting of a Co-base intermetallic compound is less than 1 mass %, the effect of enhancing sliding properties at a high temperature is small. On the other hand, if it exceeds 35 mass %, a raw powder containing the hard particles is deteriorated in compactibility prior to sintering and a high temperature sliding alloy obtained by sintering becomes hard to increase a wear loss of a mating member. Accordingly, the content of the hard particles consisting of the Co-base intermetallic compound should be 1 to 35 mass %.

The Ni-base alloy according to the invention consists of, by mass, 2 to 8% Cr, 2 to 10% Fe, 0.1 to 1.5% Si, 1.4 to 11% Mo, and the balance of Ni and incidental impurities, the each content of the above component elements being a proportion to the whole sliding alloy.

The reason why the Cr content is determined to be 2 to 8 mass % is that when it is less than 2 mass %, the matrix is liable to be deteriorated in oxidation resistance, and when it exceeds 8 mass %, it is hard to provide a high density to a green compact of a raw powder before, and thus a high density sintered product is hardly obtained. For this reason, the Cr content is preferably 2 to 8 mass %. From the viewpoint of compactibility and oxidation resistance, the Cr content is more preferably 5 to 7 mass %.

The reason why the Fe content is determined to be 2 to 10 mass % is that when it is less than 2 mass %, the alloy is liable to be deteriorated in high temperature strength, and when it is more than 10 mass %, a raw powder for sintering becomes hard so as to be hardly increased in a density of a green compact of the powder. For this reason, the Fe content is preferably 2 to 10 mass %. Particularly, when the Fe content is 4 to 6 mass %, the alloy more preferably acquires more excellent high temperature strength.

The Fe-base alloy according to the present invention is a heat resistant Fe-base alloy, and may be any one material selected from the group of austenitic, martensitic and ferritic stainless steels either of which contains Cr.

It is possible to reduce a material cost by using such a stainless steel as a matrix metal of the invention alloy.

The Co-base intermetallic compound of the hard particles is any one selected from the group of a Co—Mo—Cr—Si type, a Co—Cr—W—Ni—Fe type and a Co—Cr—Ni—Fe type.

When the Co-base intermetallic compounds are heated in an oxidizing atmosphere, Co—Mo—Cr—Si, Co—Cr—W—Ni—Fe and Co—Cr—Ni—Fe oxide phases are formed on those surfaces, respectively. Thereafter, those oxide phases are further oxidized to be a Co—Cr oxide phase.

When the Ni-base alloy is selected for making the matrix, and the Co—Mo—Cr—Si type intermetallic compound is selected as the hard particles of the Co-base intermetallic compound, the content of each element in the high temperature sliding alloy as a whole is 2 to 8 mass % Cr, 2 to 10 mass % Fe, 0.1 to 1.5 mass % Si, 2 to 22 mass % Co, 1.4 to 11 mass % Mo, 0.1 to 10 mass % Ag and the balance of Ni.

According to a second aspect of the invention, there is provided a method of producing the high temperature sliding alloy, which comprises the following steps:

mixing a powder of hard particles consisting of a Co-base intermetallic compound in an amount part of 1 to 35 mass %, a Ag powder in an amount part of 0.1 to 10 mass %, and a metal powder in a residual amount part, which powder consists of a matrix forming metal of a Ni-base alloy or an Fe-base alloy, and sintering the thus obtained mixture at a temperature of 1150 to 1200° C. in a reducing atmosphere.

In the thus sintered alloy, the hard particles have a hardness of HV 600 to 900. When the hard particles have a hardness of not lower than HV 600, the alloy can be easily improved in wear resistance property by virtue of the hard particles dispersed in the matrix. In the case of a hardness of HV 900 or lower, advantageously the alloy does not excessively attack a mating member in a mutual wearing relationship between the alloy and the mating member.

According to a third aspect of the invention, there is provided a sliding system comprising a slide bearing member having a slide bearing layer which is made of the high temperature sliding alloy mentioned above, and a mating member which is borne by the slide bearing member, wherein a slide surface of the mating member, which is brought into contact with the slide bearing layer, has preferably a Vickers hardness (Hv) of not less than 1,100.

The mating member can have a hardness of not less than HV 1,100, by hardening the surface by nitriding treatment, for example. When the slide surface is thus hard, in other words, when the slide surface is harder than the hard particles, the hard particles are not pushed into the slide surface of the mating member under a sliding-contact pressure, so that a contact area does not increase whereby easily realizing a state of low frictional resistance of the sliding system. Accordingly, a coefficient of friction between the slide bearing member and the mating member is small from room temperature to a high temperature, and wear resistance property of the slide bearing member and the mating member is improved whereby realizing the sliding system excellent in durability.

The slide surface of the mating member may be hardened also by coating other than the nitriding treatment, with a coating material of TiN, TiAlN or CrN, for example, which has good oxidation resistance property at high temperature, which coating can be conducted by ion-plating.

DETAILED DESCRIPTION OF THE INVENTION

Figure 1:
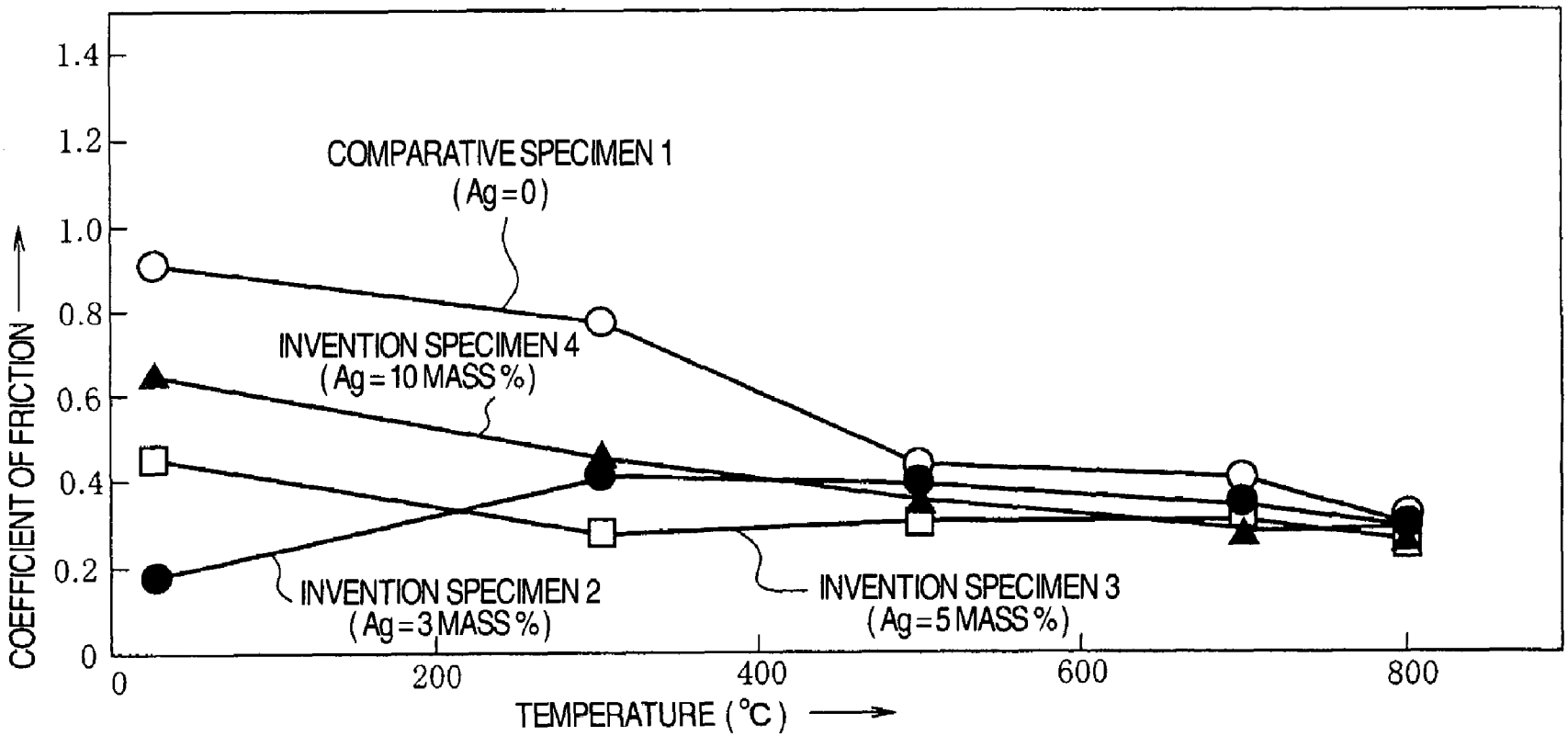
FIG. 1 is a graph showing a relationship between a testing temperature and a coefficient of friction.

Embodiments of the present invention will be now described below.

The following powders were prepared as a raw powder for preparing test samples of Invention Specimens 1 to 4 and Comparative Specimen 1 shown in Table 1 described below.

(1) Pure Ni powder: a particle size of − (minus) #250 mesh (63 μm or smaller)

(2) Fe—Cr alloy powder: a particle size of − (minus) #250 mesh (63 μm or smaller)

(3) Pure Ag powder: a particle size of − (minus) #250 mesh (63 μm or smaller)

(4) Co—Mo—Cr—Si alloy powder as hard particle: a particle size of − (minus) #250 mesh (63 μm or smaller)

The above described Fe—Cr alloy powder has a composition of 44.5 mass % Cr, 17.6 mass % Ni, 1.6 mass % Si, 4.2 mass % Mo, 0.6 mass % Mn and the balance being Fe.

In addition, the above described Co—Mo—Cr—Si alloy powder has a composition of 28.5 mass % Mo, 8.5 mass % Cr, 2.5 mass % Si and the balance being Co.

Then, the above described pure Ni powder, an Fe—Cr alloy powder, a pure Ag powder and a Co—Mo—Cr—Si alloy powder were mixed into the compositions of invention specimens 1 to 4 shown in Table 1 described below.

In addition, the pure Ni powder, the Fe—Cr alloy powder and the Co—Mo—Cr—Si alloy powder among the above described raw powders were mixed into the composition of a comparative specimen 1 in Table 1 described below, in the same way as in the above described case.

Here, the pure Ni powder and the Fe—Cr alloy powder correspond to a metal powder composing a matrix.

TABLE 1

| | matrix (mass %) | | | | | hard particle content | hard particle particle size | Ag | sintering temperature |
|---|---|---|---|---|---|---|---|---|---|
| | Ni | Cr | Fe | Si | Mo | (mass %) | (mesh) | (mass %) | (° C.) |
| Invention Specimen 1 | Balance | 7.3 | 5.3 | 0.2 | 1.7 | 10 | −#250 | 1 | 1150 |

TABLE 1-continued

| | matrix (mass %) | | | | | hard particle content | hard particle particle size | Ag | sintering temperature |
|---|---|---|---|---|---|---|---|---|---|
| | Ni | Cr | Fe | Si | Mo | (mass %) | (mesh) | (mass %) | (° C.) |
| Invention Specimen 2 | Balance | 7.3 | 5.3 | 0.2 | 1.7 | 10 | −#250 | 3 | 1150 |
| Invention Specimen 3 | Balance | 7.3 | 5.3 | 0.2 | 1.7 | 10 | −#250 | 5 | 1150 |
| Invention Specimen 4 | Balance | 7.3 | 5.3 | 0.2 | 1.7 | 10 | −#250 | 10 | 1150 |
| Comparative Specimen 1 | Balance | 7.3 | 5.3 | 0.2 | 1.7 | 10 | −#250 | — | 1150 |

For information, when preparing compositions shown in Table 1, a comparative specimen 1 which did not include Ag was prepared by mixing 73.5 mass % pure Ni powder, 16.5 mass % Fe—Cr alloy powder and 10 mass % Co—Mo—Cr—Si alloy powder by a ratio. Invention specimens 1 to 4 were prepared by decreasing the mixing percentage of the pure Ni powder by the percentage corresponding to the mixing percentage of the pure Ag powder, based on the mixing percentage of comparative specimen 1.

When a raw powder is mixed, zinc stearate in an amount of 1% with respect to the mass of the whole raw powder was mixed so as to improve compactibility of the raw powder.

Figure 4:
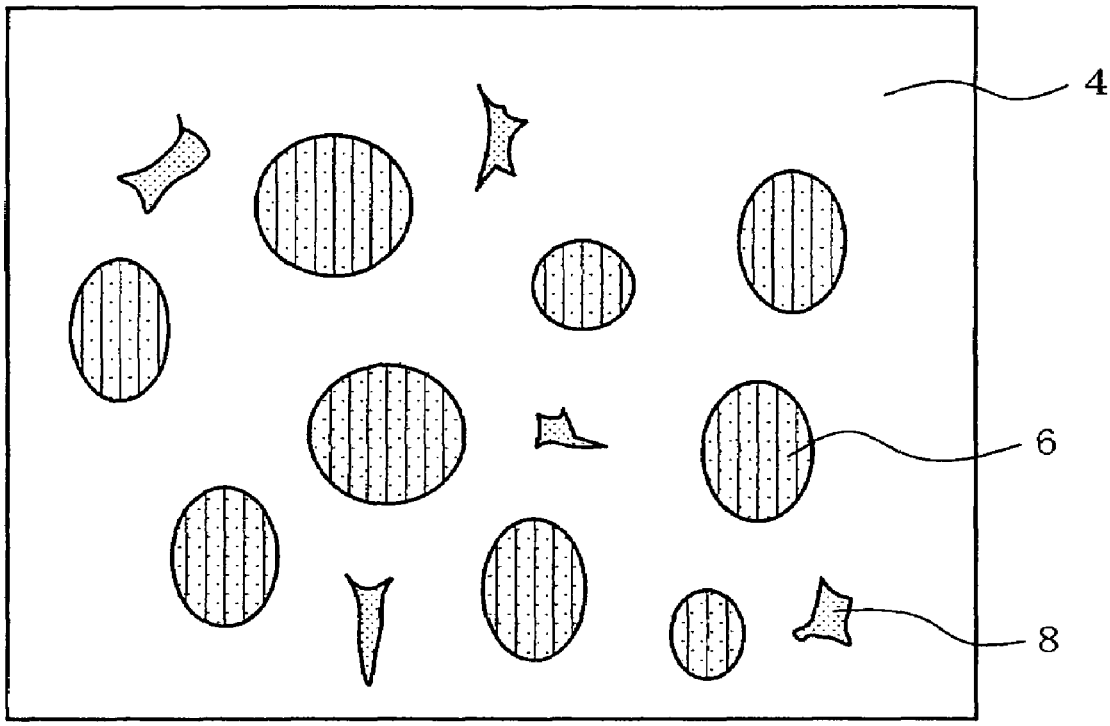
FIG. 4 is a view schematically showing a metal structure of a high temperature sliding alloy containing Ag.

Invention specimens 1 to 4 and a comparative specimen 1 were prepared by the steps of: compacting a powder mixture obtained as describe above into a cylindrical column having a diameter of 32 mm and a length of 30 mm with a compacting pressure of 6 t/cm$^2$; heating the columnar compact at 400° C. to sufficiently dewax stearic acid; and then sintering them at 1,150° C. in a reducing atmosphere of $H_2$+$N_2$ for one hour. FIG. 4 is a view schematically showing a structure of invention specimen 3, and in FIG. 4, reference numeral 4 denotes a matrix, 6 hard particles and 8 a Ag single phase.

Invention specimens 1 to 4 and a comparative specimen 1 were subjected to a wear test at each testing temperature of 20° C., 300° C., 500° C., 700° C. and 800° C. A mating member was of a ring and made of a stainless steel material having a surface hardness of HV 1,100 provided by nitriding treatment. The wear test was carried out for 60 minutes by a test condition of the surface pressure of 0.5 MPa exerted on the ring, and a rotational speed of 0.6 mm/sec. As a result of the friction test, coefficients of friction shown in FIGS. 1 and 2 were obtained.

As will be understood from the test result in FIG. 1, a comparative specimen 1 added with no Ag shows a low coefficient of friction at 500° C. or higher, but shows a high coefficient of friction at lower than 500° C.

In contrast to this, the invention specimens containing Ag shows a low coefficient of friction even at atmospheric temperature; and shows a low coefficient of friction even at 500° C. or higher. Accordingly, it is concluded that the invention specimens show a stably low coefficient of friction from atmospheric temperature to a high temperature of 800° C.

Figure 2:
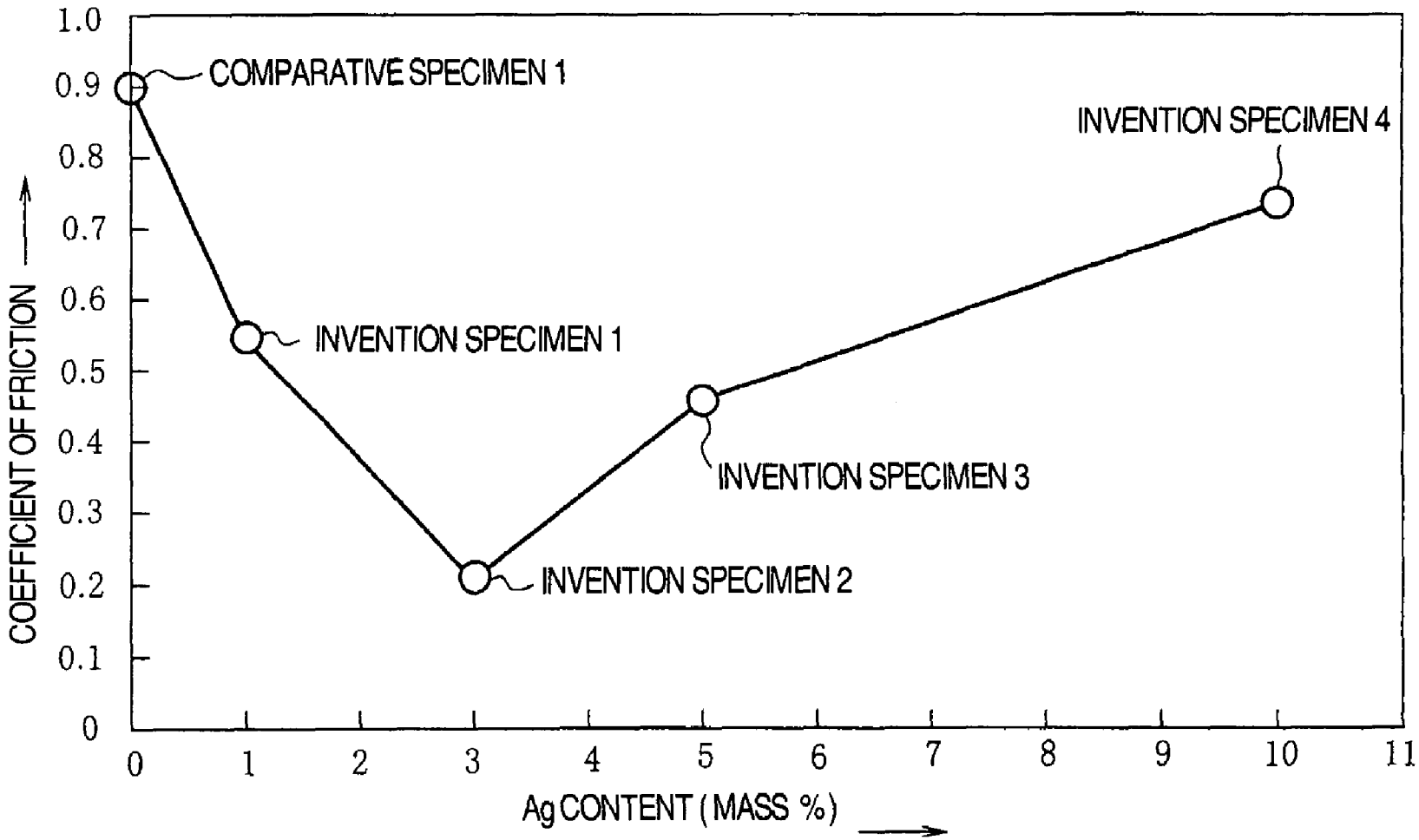
FIG. 2 is a graph showing a relationship between an Ag content and a coefficient of friction.
Figure 3:
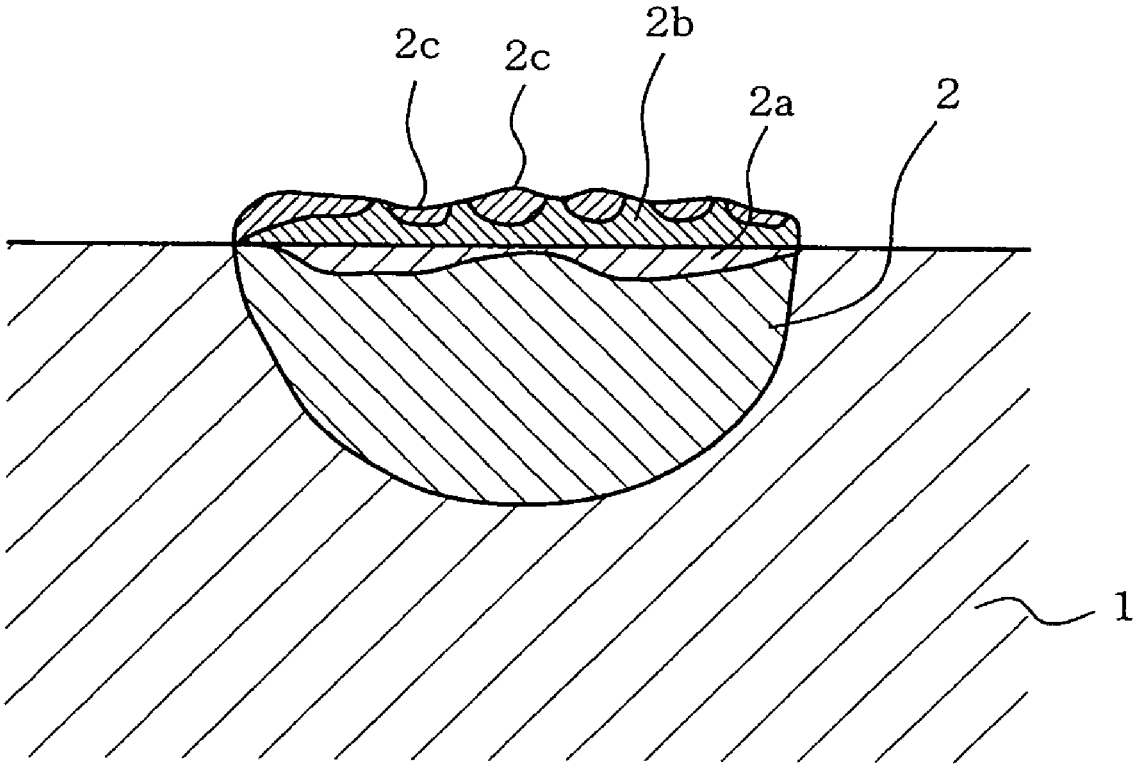
FIG. 3 is a sectional view schematically showing a state of an oxidized Co—Mo—Cr—Si type hard particle.

On the other hand, as understood from an experimental result in FIG. 2, a comparative specimen 1containing no Ag shows a high coefficient of friction. In contrast to this, invention specimens 1 to 4 added with 0.1 mass % or more Ag show a lower coefficient of friction than that of comparative specimen 1.

Invention specimens 1 to 3 containing Ag in a range of 1 to 7 mass % among the invention specimens 1 to 4 show a lower coefficient of friction. Furthermore, it can be appreciated that a specimen containing additive Ag in a range of 2 to 4 mass % such as invention specimen 2 achieves a further lower coefficient of friction.

Invention specimens 1 to 4 which are specific examples according to the present invention showed a low coefficient of friction in a low temperature range of not higher than 400° C., and a low coefficient of friction even in a high temperature range exceeding 400° C.

For information, invention specimens 1 to 4 are sintered at 1,150° C. in a reducing atmosphere, but it is confirmed by experiment that the invention specimen can show a similar low coefficient of friction even when sintered at 1,200° C.

Although the Ni-base alloys are used in the invention specimens 1 to 4 as a matrix, it is also confirmed by experiment that the invention specimen even made of an Fe-base alloy can show a similar low coefficient of friction.

The invention claimed is:

1. A high temperature sliding alloy comprising (1) a Ni-base alloy, (2) by mass, 1 to 35% of hard particles consisting of a Co-base intermetallic compound, and (3) 0.1 to 10% Ag as a separate phase, wherein the hard particles and Ag are dispersed in a matrix of the Ni-base alloy, and wherein the Ni-base alloy consists essentially of, by mass, 2 to 8% Cr, 2 to 10% Fe, 0.1 to 1.5% Si, 1.4 to 11% Mo, the balance of the Ni-base alloy being Ni and incidental impurities, and said mass percentages of the above component elements being based on the whole sliding alloy.

2. The high temperature sliding alloy according to claim 1, wherein the content of Ag in the whole sliding alloy is 1 to 7% by mass.

3. The high temperature sliding alloy according to claim 2, wherein the content of Ag in the whole sliding alloy is 2 to 4% by mass.

4. The high temperature sliding alloy according to claim 1, wherein the Co-base intermetallic compound by which the hard particles are made is any one selected from the group consisting of a Co—Mo—Cr—Si compound, a Co—Cr—W—Ni—Fe compound and a Co—Cr—Ni—Fe compound.

5. A high temperature sliding alloy comprising (1) an Fe-base alloy, (2) by mass, 1 to 35% of hard particles consisting of a Co-base intermetallic compound, and (3) 0.1 to 10% Ag as a separate phase, wherein the hard particles and Ag are distributed in a matrix of the Fe-base alloy, and wherein the Fe-base alloy is any one material selected from the group consisting of austenitic, martensitic and ferritic stainless steels, any of which contains Cr.

6. The high temperature sliding alloy according to claim 5, wherein the Co-base intermetallic compound by which the hard particles are made is any one selected from the group consisting of a Co—Mo—Cr—Si compound, a Co—Cr—W—Ni—Fe compound and a Co—Cr—Ni—Fe compound.

7. The high temperature sliding alloy according to claim 5, wherein the content of Ag in the whole sliding alloy is 1 to 7% by mass.

8. The high temperature sliding alloy according to claim 7, wherein the content of Ag in the whole sliding alloy is 2 to 4% by mass.

9. A method of producing the high temperature sliding alloy as defined in any one of claims 1, 5 and 4, which comprises the following steps:

mixing a powder of hard particles consisting of a Co-base intermetallic compound in an amount part of 1 to 35 mass %, a Ag powder in an amount part of 0.1 to 10 mass %, and a metal powder in a residual amount part, which powder consists of a matrix forming metal of a Ni-base alloy or an Fe-base alloy, and sintering the thus obtained mixture at a temperature of 1150 to 1200° C. in a reducing atmosphere.

10. A sliding system comprising a slide bearing member having a slide bearing layer which is made of a high temperature sliding alloy as defined in any one of claims 1, 5 and 4, and a mating member which is borne by the slide bearing member, wherein the mating member comprises a slide surface which is brought into contact with the slide bearing layer, and the slide surface of the mating member has a Vickers hardness (Hv) of not less than 1,100.

* * * * *

UNITED STATES PATENT AND TRADEMARK OFFICE

CERTIFICATE OF CORRECTION

PATENT NO. : 7,666,519 B2
APPLICATION NO. : 11/410006
DATED : February 23, 2010
INVENTOR(S) : Kouki Ozaki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 699 days.

Signed and Sealed this

Seventh Day of December, 2010

David J. Kappos

David J. Kappos
*Director of the United States Patent and Trademark Office*